US006663520B2

(12) United States Patent
Ou Chen

(10) Patent No.: US 6,663,520 B2
(45) Date of Patent: Dec. 16, 2003

(54) STITCHING BALL WITH INTERMEDIATE CONSTRUCTION BALL POCKET

(76) Inventor: Li Chin Ou Chen, No. 2, Alley 91, Pei Hsing Street, Feng Shan City, Kaoshiung Hsien (TW)

( * ) Notice: Subject to any disclaimer, the term of this patent is extended or adjusted under 35 U.S.C. 154(b) by 185 days.

(21) Appl. No.: 09/978,440

(22) Filed: Oct. 15, 2001

(65) Prior Publication Data

US 2003/0073527 A1 Apr. 17, 2003

(51) Int. Cl.[7] ..... A63B 41/10
(52) U.S. Cl. ..... 473/604; 473/611
(58) Field of Search ..... 473/604, 605, 473/611; 446/220, 221

(56) References Cited

U.S. PATENT DOCUMENTS 2,317,939 A * 4/1943 Riddell ..... 473/604
3,506,265 A * 4/1970 Yugi ..... 473/604
4,187,134 A * 2/1980 Svub et al. ..... 156/170
5,681,233 A * 10/1997 Guenther et al. ..... 473/605
6,106,419 A * 8/2000 Hall et al. ..... 473/604
6,390,941 B1 * 5/2002 Ou ..... 473/605
6,503,162 B1 * 1/2003 Shishido et al. ..... 473/605

* cited by examiner

*Primary Examiner*—Kien T. Nguyen
(74) *Attorney, Agent, or Firm*—Raymond Y. H. Chan; David and Raymond Patent Group

(57) ABSTRACT

An intermediate construction ball pocket includes an inflatable bladder having a valve stem extended therefrom and a fabric made construction ball pocket which has a receiving cavity defined therein for receiving the inflatable bladder therein and a valve hole provided therein for the valve stem extended to an exterior of the ball pocket bladder, wherein the ball pocket bladder is arranged to retain a true roundness shape of the inflatable bladder after inflation. The ball pocket bladder is capable of disposing in a ball carcass of a stitching ball, so as to pop up and support the ball carcass after the inflatable bladder is inflated. Therefore, intermediate construction ball pocket is adapted for retaining the roundness of the stitching ball and enhancing the softness thereof.

29 Claims, 8 Drawing Sheets

PROIR ART

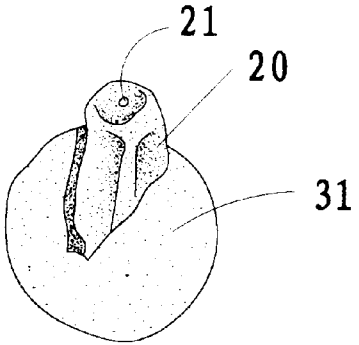
FIG. 5( I )
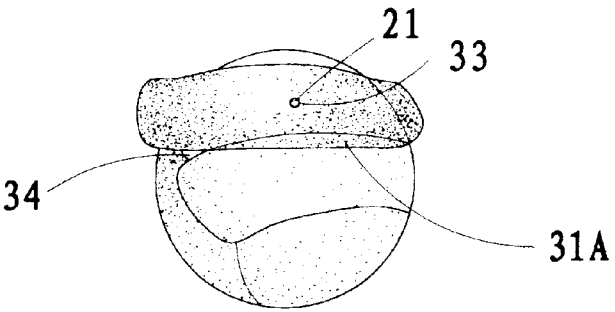
FIG. 5( J )
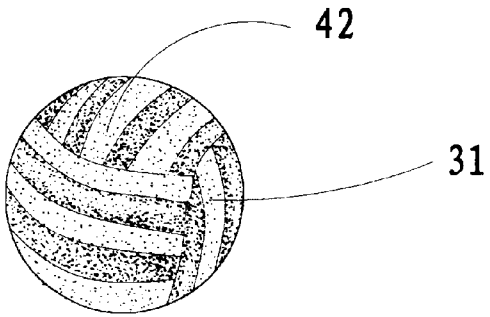
FIG. 5( K )
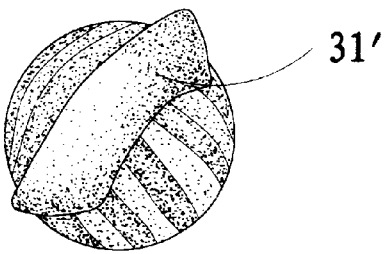
FIG. 5( L )

STITCHING BALL WITH INTERMEDIATE CONSTRUCTION BALL POCKET

BACKGROUND OF THE PRESENT INVENTION

1. Field of Invention

The present invention relates to a stitching ball, and more particularly to a stitching ball with an intermediate construction ball pocket, which can enhance the roundness of the ball without reducing the softness thereof.

2. Description of Related Arts

A conventional sport stitching ball comprises a spherical outer ball carcass comprising an inner lining layer and an inflatable bladder disposed therein for propping up and supporting the ball carcass after inflation. The ball carcass of the stitching ball comprises a plurality of carcass panels which are made of either leather or synthetic leather such as polyvinyl chloride (PVC) or polyurethane (PU) and sewn edge to edge together. The inflatable bladder is commonly made of rubber because it is durable and is capable of containing high compression air therein.

A conventional method for manufacturing the stitching ball includes the steps of:

(1) Cut each of the carcass panels into a predetermined shape.

(2) Sew the carcass panels edge to edge together to form a ball carcass, wherein one of the edge sections of the ball carcass is remained unsewn to form an inlet opening.

(3) Insert the inflatable bladder into the ball carcass through the inlet opening.

(4) Sew up the inlet opening of the ball carcass to form the stitching ball.

However, the conventional stitching ball has several drawbacks. Since the carcass panels are sewn edge to edge to form the ball carcass, a plurality of connecting edges of the carcass panels are inwardly protruded from the ball carcass such that when the inflatable bladder is inflated, the compression air will press the inflatable bladder outwardly against the interior of the ball carcass. Due to the non-spherical interior shape of the ball carcass, the compression air will irregularly press against the inflatable bladder so as to affect the roundness of the stitching ball.

Moreover, in order to control the softness of the stitching ball, a predetermined pressure of compression air, such as 10–15 psi, is pumped inside the inflatable bladder. When a larger amount of compression air, such as 15–20 psi, is pumped into the inflatable bladder, the stitching ball becomes stiffer. When a lesser amount of compression air, such as 7–8 psi, is pumped into the inflatable bladder, the stitching ball becomes softer. However, when there is insufficient compression air inside the inflatable bladder, the inflatable bladder may not able to pop up and support the ball carcass. When the inflatable bladder is over pressurized, the stitching ball will be stiffer which will highly increase the impact force for the player. Even though the lining layer of the ball carcass is functioned to retain the roundness shape of the stitching ball in a normal condition, the over inflated inflatable bladder will distort the roundness stitching ball into an irregular shape.

Thus, the stress will be created at the connecting edges of the carcass panels of the ball carcass such that the ball carcass will be easily to be worn out at the connecting edges thereof, so as to reduce the durability of the stitching ball. However, it is unreasonable for the players to pick either the roundness or softness features of the stitching ball at the same time since both features are the major concerns of the stitching ball.

SUMMARY OF THE PRESENT INVENTION

A main object of the present invention is to provide a stitching ball constructed with an intermediate construction ball pocket to receive and support the inflatable bladder to form a ball pocket bladder so as to retain and enhance the roundness of the ball without reducing the softness thereof.

Another object of the present invention is to provide a stitching ball with an intermediate construction ball pocket, which comprises a durable fabric made ball pocket to receive the inflatable bladder therein so as to provide a true roundness of the inflated inflatable bladder.

Another object of the present invention is to provide a stitching ball with an intermediate construction ball pocket, wherein the construction ball pocket can reinforce and retain the inflatable bladder in a true roundness shape even though a larger or a lesser compression air is pumped into the inflatable bladder.

Another object of the present invention is to provide a stitching ball with an intermediate construction ball pocket, wherein the compression air inside the inflatable bladder is evenly pressed against the interior of the ball carcass, so as to minimize the stress created between the connecting edges of the ball carcass and the inflatable bladder.

Another object of the present invention is to provide a stitching ball with an intermediate construction ball pocket, which can enhance the softness of the stitching ball so as to reduce the impact force for the player. Thus, The ball pocket bladder tolerates more impact on the stitching ball so as to retain the true roundness shape of the stitching ball.

Another object of the present invention is to provide a method for manufacturing the stitching ball with an intermediate construction ball pocket, wherein the manufacturing method does not require expensive machines and involved complicated structure so as to minimize the manufacturing cost of the stitching ball incorporating with the construction ball pocket.

Accordingly, in order to accomplish the above objects, the present invention provides a stitching ball strengthened with intermediate construction ball pocket, which comprises:

an inflatable bladder having a valve stem extended therefrom;

a fabric made intermediate construction ball pocket having a receiving cavity for receiving the inflatable bladder therein to form a ball pocket bladder, wherein the construction ball pocket has a valve hole for the valve stem extended to an exterior of the construction ball pocket, and is arranged to retain a true roundness shape of the inflatable bladder after inflation; and a ball carcass having a stem hole for the valve stem extended therethrough, wherein the ball pocket bladder is disposed within the ball carcass so as to pop up the and support the ball carcass after the inflatable bladder is inflated.

The present invention also provides a method of manufacturing the ball pocket bladder for stitching ball, which comprises the steps of:

(a) cutting a plurality of ball pocket leaves each having an adhesive ability into a predetermined shape;

(b) integrally bonding the ball pocket leaves together to form the spherical shaped ball pocket by overlapping edge sections of the ball pocket leaves together, wherein one of the ball pocket leaves is remained unattached to form an inlet opening for communicating a receiving cavity of the construction ball pocket with an exterior thereof;

(c) inserting the inflatable bladder into the construction ball pocket through the inlet opening; and (d) sealing the inlet opening for enclosing the receiving cavity of the construction ball pocket by adhering an additional discrete leaf to cover the inlet opening.

DETAILED DESCRIPTION OF THE PREFERRED EMBODIMENT

Figure 1:
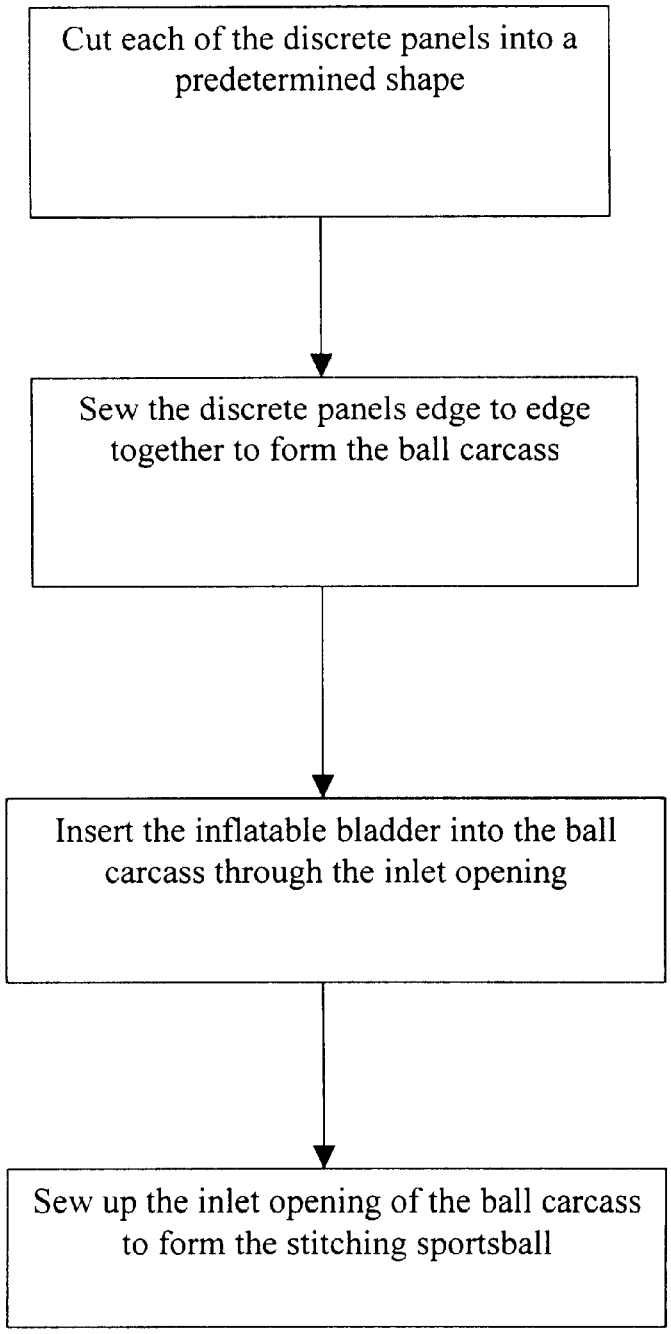
FIG. 1 is a flow chart of a method for manufacturing a conventional stitching ball.
Figure 2:
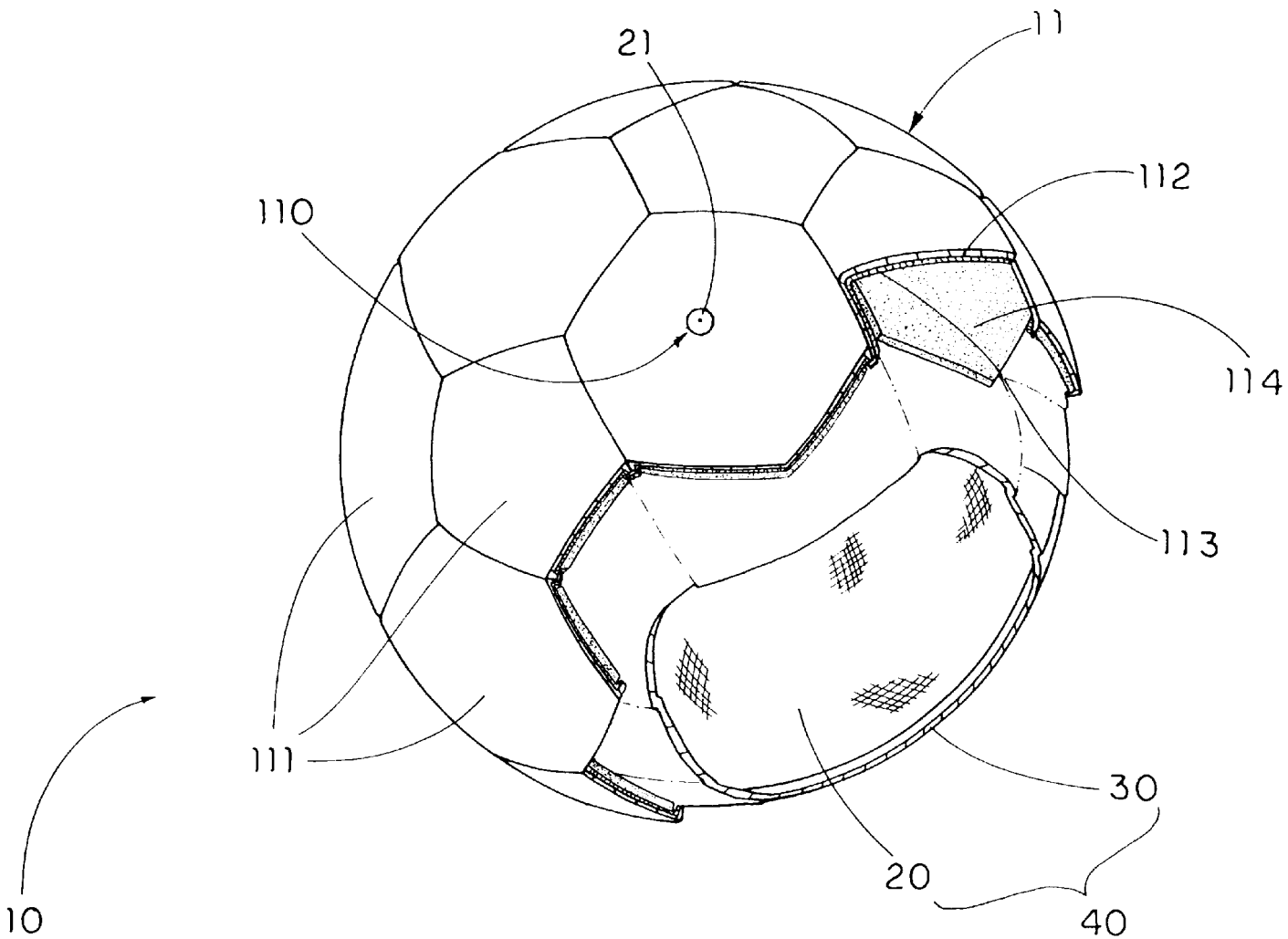
FIG. 2 is a perspective view of an intermediate construction ball pocket for stitching ball according to a preferred embodiment of the present invention.
Figure 3:
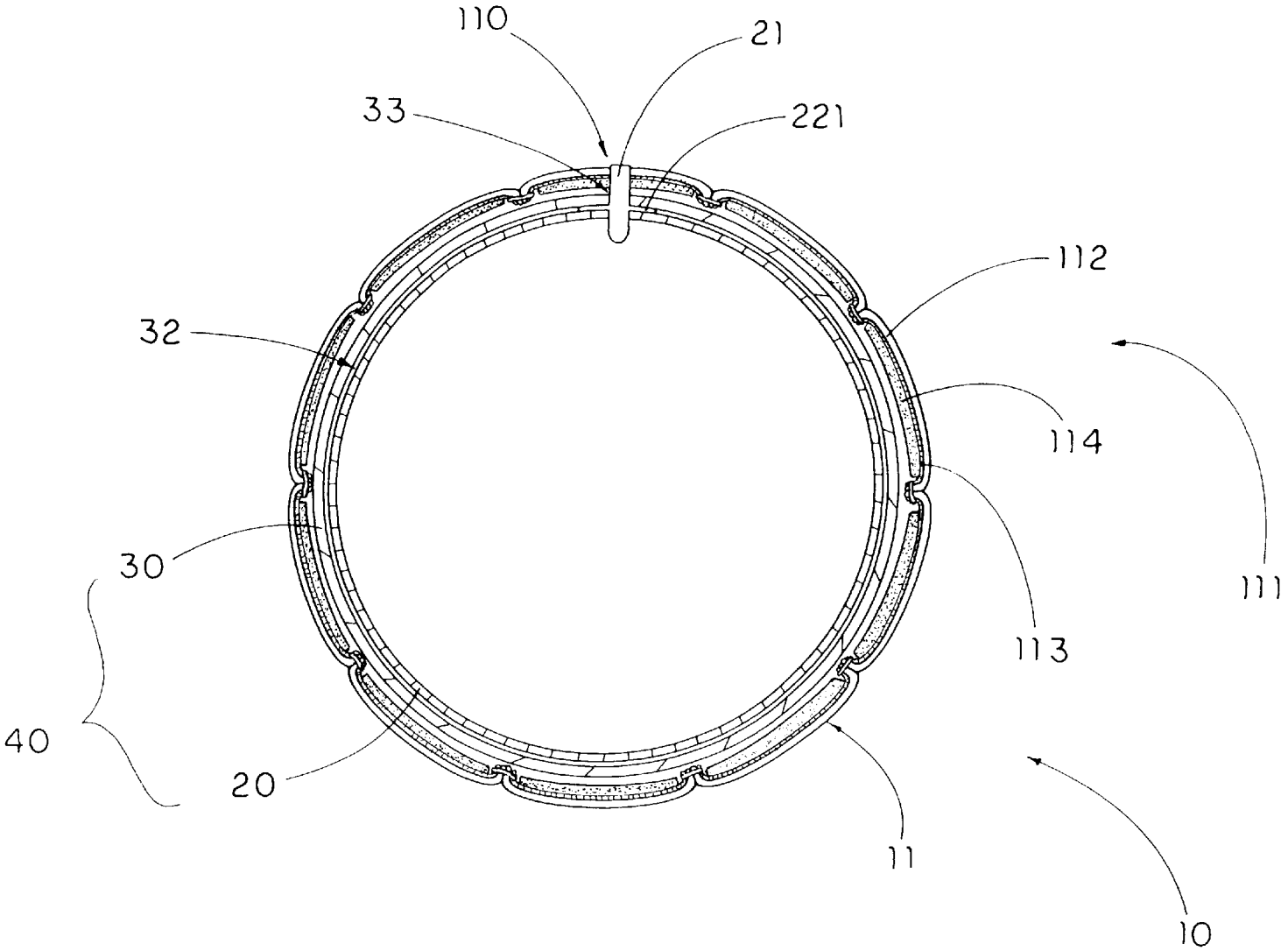
FIG. 3 is a sectional view of the ball pocket bladder for stitching ball according to the above preferred embodiment of the present invention.

Referring to FIGS. 2 and 3 of the drawings, a stitching ball according to a preferred embodiment of the present invention is illustrated, wherein the stitching ball 10, such as a basketball, volleyball, or soccer ball, comprises a ball carcass 11 having a stem hole 110 and an inflatable bladder 20 which is disposed in the ball carcass 11 and has a valve stem 21 extended therefrom to position at the stem hole 110 of the ball carcass 11. The ball carcass 11 is constructed by a plurality of carcass panels 111 connected together in an edge to edge manner, wherein the stem hole 110 is provided on one of the carcass panels 111.

The stitching ball 10 further comprises an intermediate construction ball pocket 30 disposed in the ball carcass 11 and enclosed the inflatable bladder 20 for retaining the shape of the inflatable bladder 20 to form a ball pocket bladder 40. The fabric made construction ball pocket 30 has an interior receiving cavity 32 for receiving the inflatable bladder 20 therein and a valve hole 33 for the valve stem 21 extended therethrough to position at the stem hole 110 of the ball carcass 11, wherein the construction ball pocket 30 is arranged to retain a true roundness shape of the inflatable bladder 20 after it is inflated.

According to the preferred embodiment, the inflatable bladder 20 is made of rubber or the like that is capable of being inflated with a compression air at a predetermined pressure for popping up and supporting the ball carcass 11.

The construction ball pocket 30 comprises a plurality of ball pocket leaves 31 integrally connected with each other. Practically, the fabric made construction ball pocket 30 is able to form a spherical body that the construction ball pocket 30 is constructed to have a true roundness shape so as to retain a maximum diameter of the inflatable bladder 20 after it is inflated.

As mentioned above, the construction ball pocket 30 is preferred to be made of fabric material having a durability, stretchability and adhesiveablility. Preferably, the construction ball pocket 30 can be made of a mixture fabric mixed with cotton and polyester because the cotton has a good stretchability and is able to absorb adhesive material 41 and the polyester is durable and has a strong strength that is able to resist strain when the inflatable bladder 20 is inflated.

As shown in FIG. 3, the inflatable bladder 20 is disposed in the construction ball pocket 30 which has a size slightly bigger than the inflatable bladder 20 in such a manner that when the inflatable bladder 20 is inflated, an outer spherical surface of the inflatable bladder 20 is preferred to be slightly spaced apart from an inner spherical surface of the construction ball pocket 30 to form an air cushion layer 201 is therebetween. In which, the air cushion layer 201 is adapted for providing a cushion effect for the stitching ball to provide a softness for the stitching ball and tolerate heavier impact thereon. It is worth to mention that a surrounding area 221 of the valve stem 21 which is integrally attached on the inflatable bladder 20 should be adhered on a respective surrounding area of the valve hole 33 of the construction ball pocket 30 so as to retain the valve stem 21 of the inflatable bladder 20 in position.

Figure 4:
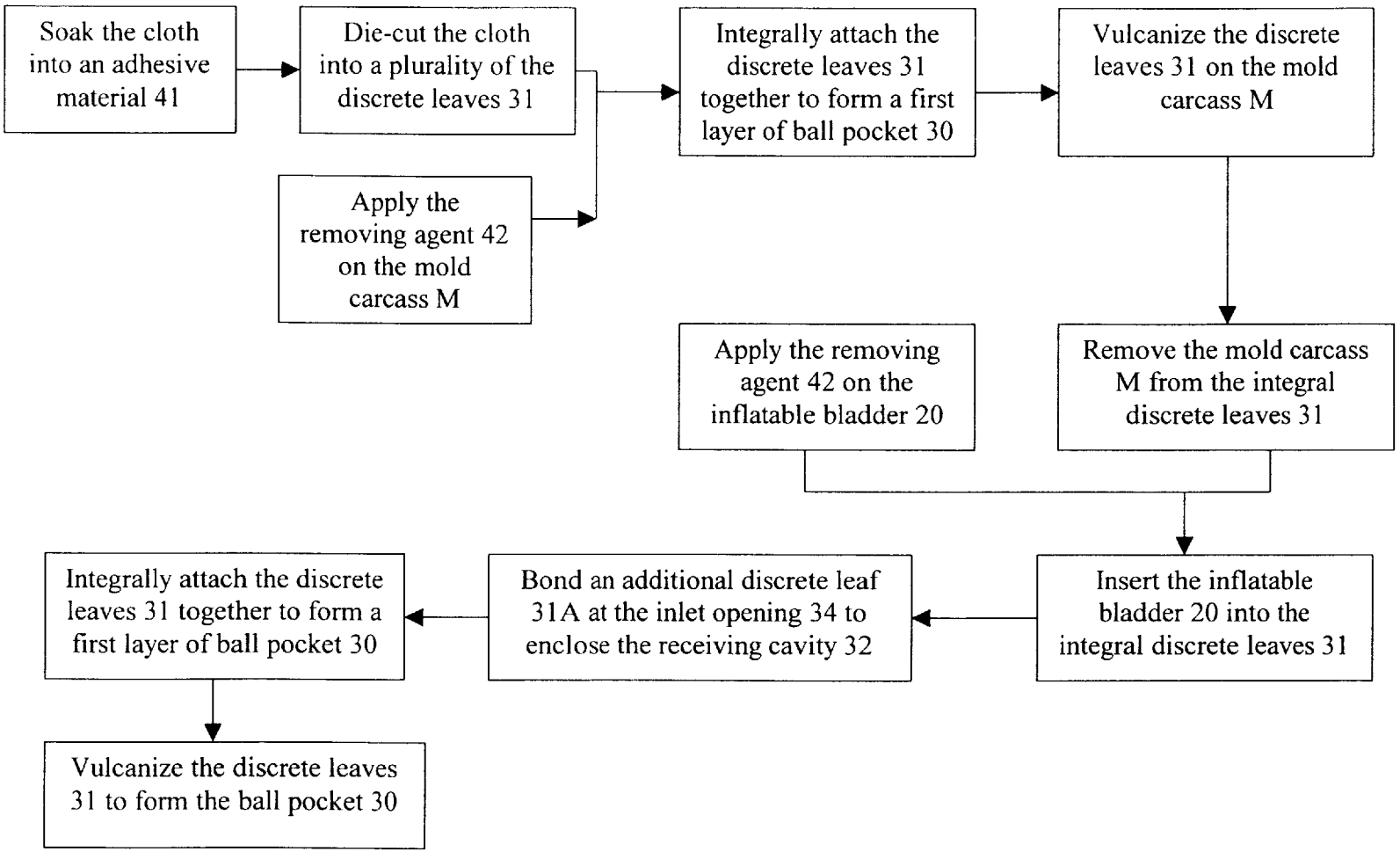
FIG. 4 is a flow chart of a method of manufacturing the ball pocket bladder for stitching ball according to the above preferred embodiment of the present invention.
Figure 5A:
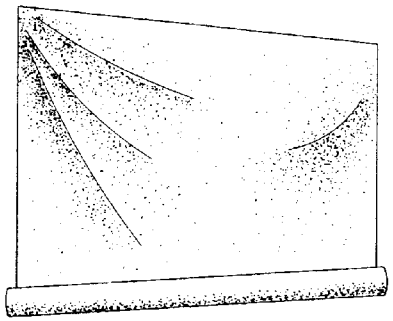
FIGS. 5(A) to 5(N) are a schematic views illustrating the method of manufacturing the ball pocket bladder for stitching ball according to the above preferred embodiment of the present invention.
Figure 5B:
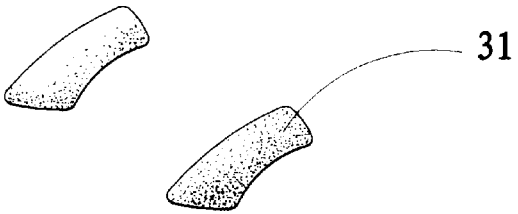

In order to better illustrate the structure of the construction ball pocket 30, it is worth to disclose how to construct an integral ball body from the plurality of ball pocket leaves. Referring to FIG. 4, a method for manufacturing the ball pocket bladder for stitching ball comprises the steps of:

(1) Provide the plurality of ball pocket leaves 31 each having an adhesive ability and a predetermined shape, as shown in FIGS. 5(A) to 5(B).

(2) Integrally connect the ball pocket leaves 31 edge with edge together by overlapping edge sections of one of the ball pocket leaves 31 with the adjacent ball pocket leaves 31 therearound so as to form a hollow round ball body as the construction ball pocket 30 defining the receiving cavity 32 therein, wherein an inlet opening 34 is form by leaving one of the ball pocket leaves 31A not being attached in this step (2), as shown in FIGS. 5(C) to 5(G).

Figure 5C:
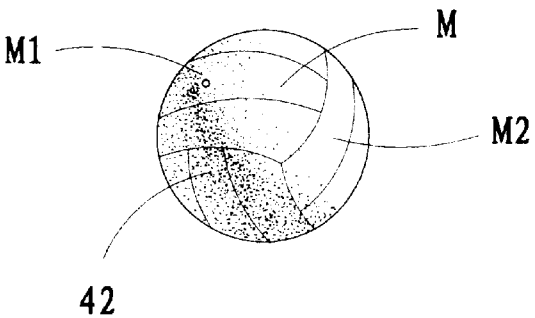
Figure 5D:
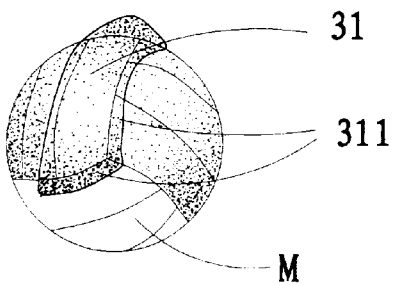
Figure 5F:
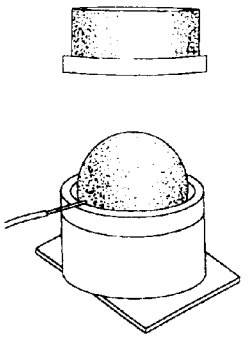
Figure 5H:
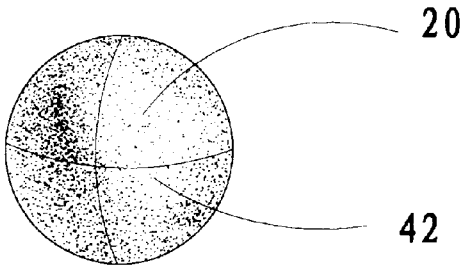
Figure 5E:
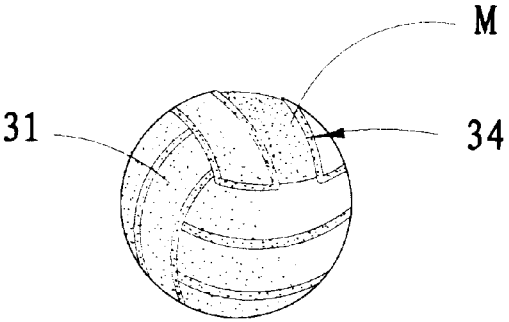
Figure 5G:
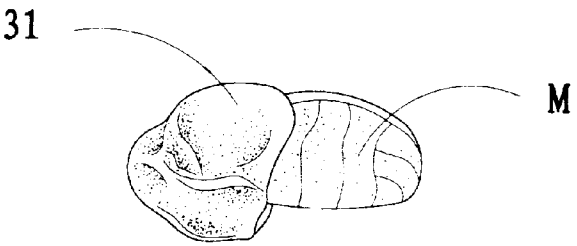

(3) Insert the inflatable bladder 20 into the construction ball pocket 30 through the inlet opening 34, as shown in FIGS. 5(H) to 5(I).

(4) Seal the inlet opening 34 and sealedly enclose the receiving cavity 32 by bonding the last ball pocket leaf 31 to cover the inlet opening 34 of the construction ball pocket 30, as shown in FIGS. 5(J) to 5(K).

Referring to FIGS. 5(A) to 5(B), the step (1) of the method for manufacturing the ball pocket bladder according to the preferred embodiment further comprises the following steps:

(1a) Soak a large piece of cotton and polyester mixture fabric cloth into an adhesive material 41 until all meshes of the fabric cloth are filled with the adhesive material 41.

(1b) Die-cut the fabric cloth into the plurality of the ball pocket leaves 31.

In step (1a), since the fabric cloth is made of fabric material, a plurality of meshes is formed on the fabric cloth. When the fabric cloth is soaked into the adhesive material 41, preferably at least three times, the adhesive material 41 will fill in the meshes of the fabric cloth so as to render the fabric cloth having a adhesive ability for attaching with each other. Preferably, the adhesive material 41 is latex which is a liquid rubber adapted to fill in all the meshes of the fabric cloth. Therefore, when the fabric cloth is cut into pieces to form the ball pocket leaves 31, all the ball pocket leaves 31 are also soaked and filled with the adhesive material 41.

According to the preferred embodiment of the present invention, the step (2) further comprises the following steps:

(2a) Evenly apply a removing agent 42 evenly on a spherical surface of an inflated spherical mold bladder M which has a true roundness shape.

(2b) Place the ball pocket leaves 31 on the spherical surface of the mold bladder M in such a manner that the edge sections of each of the ball pocket leaves 31 are overlappedly adhered with the edge sections of the adjacent ball pocket leaves 31 placed around.

(2c) Vulcanize the ball pocket leaves 31 on the mold bladder M with heat for integrally bonding the ball pocket leaves 31 together to form the construction ball pocket 30.

In the step (2a), as shown in FIG. 5(C), in order to prevent the ball pocket leaves 31 which is soaked with adhesive material being directly adhered on the spherical surface of the mold bladder M, the removing agent 42, which is a wax, is evenly applied on the spherical surface of the mold bladder M, such that the construction ball pocket 30 can be detached from the mold bladder M easily and prevent the discrete leaves 31 stunk on the mold bladder M. The mold bladder M having a valve house M1 is inflatable and can be made of rubber wherein the spherical mold bladder M has a predetermined diameter smaller than the ball carcass 11 of the stitching ball 10 after inflation.

In the step (2b), as shown in FIG. 5(C), The ball pocket leaves 31 are placed on the mold bladder M by overlapping the edge sections of the discrete leaves 31 together in such a manner that the ball pocket leaves 31 are attached to form the true roundness shape by inflating the mold bladder M through the valve house M1.

Moreover, the mold bladder M has a plurality of guiding sections M2 formed on an outer spherical surface thereof for guiding each of the ball pocket leaves 31 to place on the right position on the mold bladder M. Preferably, there are eighteen guiding sections M2 provided on the mold bladder M, as shown in FIG. 5(C), wherein every three guiding sections M2 are grouped and aligned side by side in a direction to form a group section adapted for placing three ball pocket leaves 31 thereon in a parallel manner, as shown in FIG. 5(D).

Therefore, every three ball pocket leaves 31 placed on the guiding section M2 are perpendicular to the other three ball pocket leaves 31 placed on the adjacent guiding section M2. In other words, the spherical shape of the construction ball pocket 30 can be formed by filling all the 18 pieces of ball pocket leaves 31 on the 18 guiding sections M2 on the mold bladder M.

In step (2c), during the process of vulcanization, the latex of the adhesive material 41 soaked in the ball pocket leaves 31 will be reacted to firmly bond together in such a manner that all the ball pocket leaves 31 are sealedly bonded together at the edge sections thereof to form an integral body with a predetermined thickness as the construction ball pocket 30. Preferably, the process of the vulcanization takes about two minutes for the ball pocket leaves 31 to react to bond together. Accordingly, as shown in FIG. 2, after the vulcanization step (2c), the overlapped edge sections of all the ball pocket leaves 31 are integrated to form a single piece structure.

In order to remove the construction ball pocket 30 from the mold bladder M, release the compression air inside the mold bladder M to shrink the mold bladder M in such a manner that mold bladder M can be removed from the construction ball pocket 30 easily through the inlet opening 34. It is worth to mention that since the inflated mold bladder M is made to have a true roundness shape, the receiving cavity 32 of the construction ball pocket 30 is shaped in the true roundness shape as well.

In the step (3), the inflatable bladder 20 is inserted into the construction ball pocket 30 through the inlet opening 34. In order to prevent the outer spherical surface of the inflatable bladder 20 bond to the inner spherical surface of the construction ball pocket 30, as shown in FIG. 5(H), the removing agent 42 is also evenly applied on the outer spherical surface of the inflatable bladder 20 before the inflatable bladder 20 is inserted into the construction ball pocket 30. Accordingly, the air cushion layer 201 will be formed between the outer spherical surface of the inflatable bladder 20 and the inner spherical surface of the construction ball pocket 30 after the inflatable bladder 20 is inflated.

As disclosed in the above step (2), the inlet opening 34 is form by leaving the last ball pocket leaf 31A not to be attached, in the step (4), the last ball pocket leaf 31A which is also soaked with the adhesive material 41 is placed on the construction ball pocket 30 to cover the inlet opening 34 and enclose the receiving cavity 32, wherein the valve hole 33 is provided on the last ball pocket leaf 31A and aligned with the valve stem 21 of the inflatable bladder 20.

The present invention further comprises a step of:

(5) Vulcanizing the construction ball pocket 30 with heat for integrally enclosing the inlet opening 34 of the construction ball pocket 30.

In the step (4), the present invention further comprises an additional step of:

(4a) overlappedly placing a second layer of ball pocket leaves 31' on the inflatable bladder 20.

In step (4a), as shown in FIGS. 5(K) to 5(L), the second layer of ball pocket leaves 31' is overlappedly bonded on the first layer of the ball pocket leaves 31 for enhancing the strength of the construction ball pocket 30. In order to integrally bond the first and second layers of the ball pocket leaves 31, 31' together, the adhesive material 41 is evenly applied on the first layer of the ball pocket leaves 31, such that when the second layer of ball pocket leaves 31' is placed thereon, the first and second layers can be integrally bonded to each other by means of vulcanization. It is worth to mention that third layer or fourth layer of the ball pocket leaves 31 can be overlappedly bonded on the second layer to increase the strength of the construction ball pocket 30.

It is worth to mention that each of the ball pocket leaves 31' of the second layer is arranged and aligned to be placed perpendicularly to the respective ball pocket leaf 31 of the first layer positioned right below in an overlapping manner so as to form a cross structure for the first and second layers. Of course, one of the pocket leaves 31A' of the second layer also has a through hole aligned with the valve stem 21 of the inflatable bladder 20.

Figure 5N:
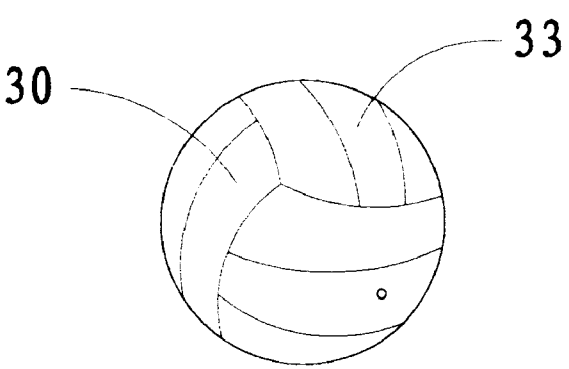
Figure 5M:
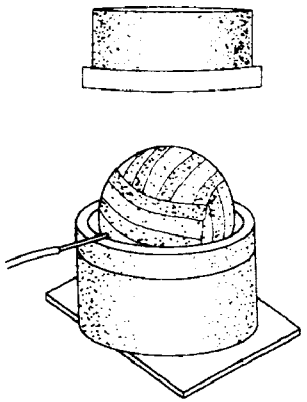

In the step (5), during the process of vulcanization, which requires about four to five minutes, the inflatable bladder 20 should be inflated with a predetermined amount of compression air for retaining the shape of the construction ball pocket 30. Moreover, the first and second layers of the ball pocket leaves 31, 31' will be integrally bonded to together to form the construction ball pocket 30, as shown in FIGS. 5(M) to 5(N).

Thus, the removing agent 42 can be applied on the outer spherical surface of the inflatable bladder 20 in such a manner that the outer spherical surface of the inflatable bladder 20 will not be attached to the inner spherical surface of the construction ball pocket 30. It is worth to mention that the removing agent 42 should not be applied on the surrounding area 211 of the stem valve 21 of the inflatable bladder 20 such that the surrounding area 211 of the stem valve 21 is bonded on the construction ball pocket 30 at the surrounding area of the valve hole 33 of the construction ball pocket 30.

Since the construction ball pocket 30 is made to have a substantial true roundness shape, the inflatable bladder 20 is urged and retained in the true roundness shape having a maximum diameter. Therefore, when the predetermined pressure of the compression air, such as standard pressure 11 psi, is pumped into the inflatable bladder 20, the inflatable bladder 20 is formed in the true roundness shape. When a larger pressure of the compression air, such as 15–20 psi, is pumped into the inflatable bladder 20 to form a stiffer thereof, the construction ball pocket 30 can retain the inflatable bladder 20 with the maximum diameter thereof to form the true roundness shape without distort the shape of the inflatable bladder 20. It is worth to mention that when the lesser pressure of the compression air, such as 7–8 psi, is pumped into the inflatable bladder 20, the inflatable bladder 20 is softer and remained in the true roundness shape. However, the inflatable bladder of the conventional ball will be distorted when larger or lesser pressure of compression air is applied thereon.

It is worth to mention that the ball pocket bladder can be a ball itself especially for young kids to play since the impact force of the ball pocket bladder of the present invention is relatively smaller, so as to prevent any unwanted injury when the player is hit by the impact force while receiving the ball.

For professional stitching ball 10, which has the ball pocket bladder disposed therein, each carcass panel 111 of the ball carcass 11 is constructed by an outer cover layer 112 and an inner lining layer 113 attached under the cover layer 112, wherein the carcass panels 111 are connected edge to edge to form the spherical ball carcass 11 to receive the ball pocket bladder therein.

The cover layer 112 can be made of durable material such as leather, rubber, or synthetic leather such as polyvinyl chloride (PVC) or polyurethane (PU). The inner lining 113 is made of fabric material for providing the stiffness of the carcass panel 112, so as to tolerate impact and retain the shape of the ball carcass 111.

In order to provide a softer feeling when the player contacts the ball 10, after the carcass panels 111 are sewn together edge by edge to form the ball carcass 11, a cushion pad 114 is shaped to fittingly attach under each of the carcass panels 111, i.e. adhered to the lining layer 113 of each carcass panel 111. The cushion pad 114 is made of foam material that is capable of softening the ball carcass 111 and absorbing an impact force exerted on the ball carcass 111, wherein a thickness of each of said cushion pads is made to fit a clearance formed between each of said carcass panels and an outer surface of said construction ball pocket after inflated.

It is worth to mention that when the outer cover layers 112 of the carcass panels 111 are made of leather, no inner lining layer 113 is required so that the cushion pad 114 can be directly adhered to the inner side of the cover layer 112. If the outer cover layer 112 is made of synthetic leather such as PVC or PU, inner lining layer 113 is needed to attach with the cover layer 112, so that the cushion pad 114 is adhered to the inner surface of the lining layer 113. Of course, it is fine to attach another lining layer under each of the cushion pad 114 to prevent the soft cushion pad 114 from direct contact with the construction ball pocket 30.

Since the maximum diameter of the inflatable bladder 20 is limited by the construction ball pocket 30 to provide a true roundness shape of the inflatable bladder 20, the compression air within the inflatable bladder 20 will be evenly pressed against an inner spherical surface of the ball carcass 11. Therefore, the stitching ball 10 can be obtained a true roundness shape while enhancing its softness feature so that the player is able to control the stitching ball 10 easily. Thus, the stress at the edge connections of the carcass panels 111 can be minimized, so as to prevent the stitching ball 10 from being worn out at the edge connections. In other words, the stitching ball 10 incorporated with the ball pocket bladder 30 is more durable than the conventional stitching ball and is capable of prolonging the service life span of the stitching ball 10.

What is claimed is:

1. A ball pocket bladder adapted for disposing in a ball carcass of a stitching ball for propping up and supporting said ball carcass, comprising:

an inflatable bladder having a valve stem extended therefrom; and a construction ball pocket, which is made of fabric material and constructed to have a true roundness shape, having an interior receiving cavity defined therein to sealedly receive said inflatable bladder inside and a valve hole for said valve stem extended therethrough to an exterior of said construction ball pocket, wherein said construction ball pocket is arranged to retain a true roundness shape of said inflatable bladder after said inflatable bladder is inflated, wherein an outer spherical surface of said inflatable bladder is spaced apart from an inner spherical surface of said construction ball pocket so as to form an air cushion layer therebetween.

2. The ball pocket bladder, as recited in claim 1, wherein a surrounding area of said valve stem of said inflatable bladder is attached on a respective surrounding area of said valve hole of said construction ball pocket so as to retain said valve stem of said inflatable bladder in position.

3. The ball pocket bladder, as recited in claim 2, wherein said ball pocket leaves are connected with each other by overlapping and integrally bonding edge sections of each of said ball pocket leaves with said edge sections of said adjacent ball pocket leaves therearound by means of vulcanization with heat.

4. The ball pocket bladder, as recited in claim 1, wherein said ball pocket leaves are connected with each other by overlapping and integrally bonding edge sections of each of said ball pocket leaves with said edge sections of said adjacent ball pocket leaves therearound by means of vulcanization with heat.

5. A ball pocket bladder adapted for disposing in a ball carcass of a stitching ball for propping up and supporting said ball carcass, comprising:

an inflatable bladder having a valve stem extended therefrom; and a construction ball pocket, which is made of fabric material and constructed to have a true roundness shape, having an interior receiving cavity defined therein to sealedly receive said inflatable bladder inside and a valve hole for said valve stem extended therethrough to an exterior of said construction ball pocket, wherein said construction ball pocket is arranged to retain a true roundness shape of said inflatable bladder after said inflatable bladder is inflated, wherein said ball pocket comprises a plurality of ball pocket leaves integrally connected edge to edge together to form said construction ball pocket having a spherical shape, wherein an outer spherical surface of said inflatable bladder is spaced apart from an inner spherical surface of said construction ball pocket so as to form an air cushion layer therebetween.

6. The ball pocket bladder, as recited in claim 5, wherein a surrounding area of said valve stem of said inflatable bladder is attached on a respective surrounding area of said valve hole of said construction ball pocket so as to retain said valve stem of said inflatable bladder in position.

7. The ball pocket bladder, as recited in claim 6, wherein said ball pocket leaves are connected with each other by overlapping and integrally bonding edge sections of each of said ball pocket leaves with said edge sections of said adjacent ball pocket leaves therearound by means of vulcanization with heat.

8. The ball pocket bladder, as recited in claim 5, wherein said ball pocket leaves are connected with each other by overlapping and integrally bonding edge sections of each of said ball pocket leaves with said edge sections of said adjacent ball pocket leaves therearound by means of vulcanization with heat.

9. A method for manufacturing a ball pocket bladder, adapted for disposing in a ball carcass of a stitching ball for propping up and supporting said ball carcass, comprising the steps of:

(a) providing a plurality of ball pocket leaves each having a predetermined shape and being soaking with an adhesive material until meshes of said ball pocket leaf are filled with said adhesive material;

(b) integrally connecting said ball pocket leaves edge with edge together by overlapping edge sections of one of said ball pocket leaves with said adjacent ball pocket leaves therearound so as to form a hollow round ball body defining said receiving cavity therein, wherein one of said ball pocket leaves is remained unattached to form an inlet opening, wherein the step (b) comprises the steps of:

(b-1) applying a removing agent on a spherical surface of an inflated spherical mold bladder having a true roundness shape, (b-2) placing said ball pocket leaves on said spherical surface of said mold bladder in such a manner that said edge sections of each of said ball pocket leaves are overlappedly adhered with said edge sections of said adjacent ball pocket leaves placed therearound, and (b-3) vulcanizing said ball pocket leaves on said mold bladder with heat for integrally bonding said ball pocket leaves together to form said hollow round ball body having said inlet opening provided thereon;

(c) inserting an inflatable bladder into said hollow round ball body through said inlet opening; and (d) sealing said inlet opening with said ball pocket leaf remained unattached in the step (b) for sealedly enclosing said receiving cavity said hollow round ball body to form said ball pocket bladder.

10. The method, as recited in claim 9, wherein said mold bladder has a plurality of guiding sections formed on an outer spherical surface thereof for guiding each of said ball pocket leaves to place on said mold bladder.

11. The method, as recited in claim 9, wherein the step (b) further comprises the step of:

(b.4) releasing a compression air inside said inflated mold bladder to shrink said mold bladder; and (b.5) removing said mold bladder from said hollow round ball body through said inlet opening.

12. The method, as recited in claim 11, after the step (b) and before the step (c), further comprising a step of also applying said removing agent on said inflatable bladder.

13. The method, as recited in claim 12, wherein the step (d) further comprises the steps of:

(d.1) covering said inlet opening on said hollow round ball body by adhering said edge sections of said ball pocket leaf remained unattached in the step (b) with said edge sections of said adjacent ball pocket leaves positioned therearound; and (d.2) vulcanizing said construction ball pocket with heat for integrally enclosing said inlet opening of said construction ball pocket and securely receiving said inflatable bladder therein.

14. The method, as recited in claim 12, wherein the step (d) further comprises the steps of:

(d.1) covering said inlet opening on said hollow round ball body by adhering said edge sections of said ball pocket leaf remained unattached in the step (b) with said edge sections of said adjacent ball pocket leaves positioned therearound to form a first layer of ball pocket leaves;

(d.2) overlappedly adhering a second layer of ball pocket leaves on said first layer of ball pocket leaves; and (d.3) vulcanizing said first and second layers of ball pocket leaves with heat until all said ball pocket leaves are integrated to form an integral layer to form said construction ball pocket.

15. The method, as recited in claim 14, wherein each of said ball pocket leaves of said second layer of ball pocket leaves is arranged and aligned to be placed perpendicularly to said respective ball pocket leaf of said first layer of ball pocket leaves which is positioned right below.

16. The method, as recited in claim 9, wherein the step (d) further comprises the steps of:

(d.1) covering said inlet opening on said hollow round ball body by adhering said edge sections of said ball pocket leaf remained unattached in the step (b) with said edge sections of said adjacent ball pocket leaves positioned therearound; and (d.2) vulcanizing said construction ball pocket with heat for integrally enclosing said inlet opening of said construction ball pocket and securely receiving said inflatable bladder therein.

17. The method, as recited in claim 9, wherein the step (d) further comprises the steps of:

(d.1) covering said inlet opening on said hollow round ball body by adhering said edge sections of said ball pocket leaf remained unattached in the step (b) with said edge sections of said adjacent ball pocket leaves positioned therearound to form a first layer of ball pocket leaves;

(d.2) overlappedly adhering a second layer of ball pocket leaves on said first layer of ball pocket leaves; and (d.3) vulcanizing said first and second layers of ball pocket leaves with heat until all said ball pocket leaves are integrated to form an integral layer to form said construction ball pocket.

18. The method, as recited in claim 17, wherein each of said ball pocket leaves of said second layer of ball pocket leaves is arranged and aligned to be placed perpendicularly to said respective ball pocket leaf of said first layer of ball pocket leaves which is positioned right below.

19. A method for manufacturing a ball pocket bladder, adapted for disposing in a ball carcass of a stitching ball for propping up and supporting said ball carcass, comprising the steps of:

(a) providing a plurality of ball pocket leaves each having an adhesive ability and a predetermined shape;

(b) integrally connecting said ball pocket leaves edge with edge together by overlapping edge sections of one of said ball pocket leaves with said adjacent ball pocket leaves therearound so as to form a hollow round ball body defining said receiving cavity therein, wherein one of said ball pocket leaves is remained unattached to form an inlet opening;

(c) applying a removing agent on said inflatable bladder;

(d) inserting an inflatable bladder into said hollow round ball body through said inlet opening; and (e) sealing said inlet opening with said ball pocket leaf remained unattached in the step (b) for sealedly enclosing said receiving cavity said hollow round ball body to form said ball pocket bladder.

20. A stitching ball, comprising:

an inflatable bladder having a valve stem extended therefrom;

a construction ball pocket, which is made of fabric material and constructed to have a true roundness shape, having an interior receiving cavity defined therein to sealedly receive said inflatable bladder inside and a valve hole for said valve stem extended therethrough to an exterior of said construction ball pocket, wherein said construction ball pocket is arranged to retain a true roundness shape of said inflatable bladder after said inflatable bladder is inflated, wherein an outer spherical surface of said inflatable bladder is spaced apart from an inner spherical surface of said construction ball pocket so as to form an air cushion layer therebetween; and a ball carcass, which comprises a plurality of carcass panels sewn edge to edge together, receiving said construction ball pocket therein and having a stem hole for said valve stem attached thereto, wherein said inflatable bladder is capable of popping up and supporting said ball carcass after said inflatable bladder is inflated.

21. The stitching ball, as recited in claim 20, wherein a surrounding area of said valve stem of said inflatable bladder is attached on a respective surrounding area of said valve hole of said construction ball pocket so as to retain said valve stem of said inflatable bladder in position.

22. The stitching ball, as recited in claim 21, said ball pocket leaves are connected with each other by overlapping and integrally bonding edge sections of each of said ball pocket leaves with said edge sections of said adjacent ball pocket leaves therearound by means of vulcanization with heat.

23. A stitching ball, comprising:

an inflatable bladder having a valve stem extended therefrom;

a construction ball pocket, which is made of fabric material and constructed to have a true roundness shape, having an interior receiving cavity defined therein to sealedly receive said inflatable bladder inside and a valve hole for said valve stem extended therethrough to an exterior of said construction ball pocket, wherein said construction ball pocket is arranged to retain a true roundness shape of said inflatable bladder after said inflatable bladder is inflated, wherein said construction ball pocket comprises a plurality of ball pocket leaves integrally connected edge to edge together to form said construction ball pocket having a spherical shape, wherein an outer spherical surface of said inflatable bladder is spaced apart from an inner spherical surface of said construction ball pocket so as to form an air cushion layer therebetween; and a ball carcass, which comprises a plurality of carcass panels sewn edge to edge together, receiving said construction ball pocket therein and having a stem hole for said valve stem attached thereto, wherein said inflatable bladder is capable of popping up and supporting said ball carcass after said inflatable bladder is inflated.

24. The stitching ball, as recited in claim 23, wherein a surrounding area of said valve stem of said inflatable bladder is attached on a respective surrounding area of said valve hole of said construction ball pocket so as to retain said valve stem of said inflatable bladder in position.

25. The stitching ball, as recited in claim 24, wherein said ball pocket leaves are connected with each other by overlapping and integrally bonding edge sections of each of said ball pocket leaves with said edge sections of said adjacent ball pocket leaves therearound by means of vulcanization with heat.

26. The stitching ball, as recited in claim 25, wherein said ball carcass further comprises a plurality of cushion pads which are shaped to fittingly attach under said carcass panels respectively.

27. The stitching ball, as recited in claim 24, wherein said ball carcass further comprises a plurality of cushion pads which are shaped to fittingly attach under said carcass panels respectively.

28. The stitching ball, as recited in claim 23, wherein said ball pocket leaves are connected with each other by overlapping and integrally bonding edge sections of each of said ball pocket leaves with said edge sections of said adjacent bail pocket leaves therearound by means of vulcanization with heat.

29. A stitching ball, comprising:

an inflatable bladder having a valve stem extended therefrom;

a construction ball pocket, which is made of fabric material and constructed to have a true roundness shape, having an interior receiving cavity defined therein to sealedly receive said inflatable bladder inside and a valve hole for said valve stem extended therethrough to an exterior of said construction ball pocket, wherein said construction ball pocket is arranged to retain a true roundness shape of said inflatable bladder after said inflatable bladder is inflated, wherein an outer spherical surface of said inflatable bladder is spaced apart from an inner spherical surface of said construction ball pocket so as to form an air cushion layer therebetween, wherein said ball pocket leaves are connected with each other by overlapping and integrally bonding edge sections of each of said ball pocket leaves with said edge sections of said adjacent ball pocket leaves therearound by means of vulcanization with heat; and a ball carcass, which comprises a plurality of carcass panels sewn edge to edge together, receiving said construction ball pocket therein and having a stem hole for said valve stem attached thereto, wherein said inflatable bladder is capable of popping up and supporting said ball carcass after said inflatable bladder is inflated.

* * * * *